US010653196B2

(12) United States Patent
Wang et al.

(10) Patent No.: US 10,653,196 B2
(45) Date of Patent: May 19, 2020

(54) INTELLIGENT FABRIC AND INTELLIGENT GARMENT

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shijun Wang, Beijing (CN); Wenbo Jiang, Beijing (CN); Yanna Xue, Beijing (CN); Yue Li, Beijing (CN); Zhiying Bao, Beijing (CN); Wenjun Xiao, Beijing (CN); Zhenhua Lv, Beijing (CN); Yong Zhang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 957 days.

(21) Appl. No.: 15/200,434

(22) Filed: Jul. 1, 2016

(65) Prior Publication Data

US 2017/0079351 A1 Mar. 23, 2017

(30) Foreign Application Priority Data

Sep. 21, 2015 (CN) ..... 2015 1 0603819

(51) Int. Cl.
*A41D 27/28* (2006.01)
*A41D 13/002* (2006.01)
(Continued)

(52) U.S. Cl.
CPC ..... *A41D 27/28* (2013.01); *A41D 1/002* (2013.01); *A41D 1/06* (2013.01); *A41D 13/002* (2013.01); *A41D 27/285* (2013.01)

(58) Field of Classification Search
CPC ..... A41D 27/28; A41D 1/002; A41D 1/06; A41D 13/002; A41D 27/285;
(Continued)

(56) References Cited

U.S. PATENT DOCUMENTS 9,609,901 B2 * 4/2017 Nordstrom ..... A41D 27/00
10,299,520 B1 * 5/2019 Shaffer ..... A41D 1/005
(Continued)

FOREIGN PATENT DOCUMENTS

CN 203376633 U 1/2014
CN 203873046 U 10/2014
(Continued)

OTHER PUBLICATIONS

Office Action regarding Chinese Application No. 2015106038191, dated Mar. 7, 2016. Translation provided by Dragon Intellectual Property Law Firm.

*Primary Examiner* — Anna K Kinsaul
*Assistant Examiner* — F Griffin Hall
(74) *Attorney, Agent, or Firm* — Harness, Dickey & Pierce, P.L.C.

(57) ABSTRACT

An intelligent fabric includes: a base layer with vent holes, a thermal insulation layer on the base layer and capable of being moved relative to the base layer, an instruction generator configured to generate a switch instruction, and a controller connected to the instruction generator and the thermal insulation layer, and configured to control the thermal insulation layer to be moved relative to the base layer in accordance with the switch instruction, so as to switch the thermal insulation layer between a state where the thermal
(Continued)

insulation layer covers the vent holes completely and a state where the thermal insulation layer does not cover the vent holes, or among the state where the thermal insulation layer covers the vent holes completely, a state where the thermal insulation layer partially covers the vent holes, and the state where the thermal insulation layer does not cover the vent holes.

16 Claims, 9 Drawing Sheets

(51) Int. Cl.
*A41D 1/00* (2018.01)
*A41D 1/06* (2006.01)

(58) Field of Classification Search
CPC ..... G05B 19/418; G05D 23/23; B32B 3/266; B32B 5/02; B32B 2307/308; B32B 2437/02; B32B 2457/00
USPC ..... 2/69; 318/445
See application file for complete search history.

(56) References Cited

U.S. PATENT DOCUMENTS

2005/0249917 A1* 11/2005 Trentacosta ..... A41D 31/102 428/137
2014/0053312 A1* 2/2014 Nordstrom ..... A41D 1/00 2/69
2017/0112201 A1* 4/2017 Lv ..... B32B 5/04

FOREIGN PATENT DOCUMENTS

CN 104216440 A 12/2014
CN 104872873 A 9/2015

* cited by examiner

INTELLIGENT FABRIC AND INTELLIGENT GARMENT

CROSS-REFERENCE TO RELATED APPLICATION

The present application claims a priority of the Chinese patent application No. 201510603819.1 filed on Sep. 21, 2015, which is incorporated herein by reference in its entirety.

TECHNICAL FIELD

The present disclosure relates to the field of health care, in particular to an intelligent fabric and an intelligent garment.

BACKGROUND

More and more people take exercises, e.g., running and playing ball games, so as to keep fit. Usually, at a low temperature, people will be dressed in thick sportswear. However, sweat generated during the exercise will not be evaporated in time. In the case that people are dressed in thin sportswear, they will feel cold before the exercise or it is impossible to maintain their body temperatures after the exercise, so they will catch cold easily.

SUMMARY

An object of the present disclosure is to provide an intelligent fabric and an intelligent garment, so as to keep a user warm in the case of a low body temperature and dissipate heat rapidly in the case of a high body temperature.

In one aspect, the present disclosure provides in some embodiments an intelligent fabric, including: a base layer with vent holes and a thermal insulation layer on the base layer and capable of being moved relative to the base layer; an instruction generator configured to generate a switch instruction; and a controller connected to the instruction generator and the thermal insulation layer, and configured to control the thermal insulation layer to be moved relative to the base layer in accordance with the switch instruction from the instruction generator, so as to switch the thermal insulation layer between a state where the thermal insulation layer covers the vent holes completely and a state where the thermal insulation layer does not cover the vent holes, or among the state where the thermal insulation layer covers the vent holes completely, a state where the thermal insulation layer partially covers the vent holes, and the state where the thermal insulation layer does not cover the vent holes.

Alternatively, the instruction generator includes: a humidity sensor configured to detect humidity information; and an instruction generation unit connected to the humidity sensor, and configured to generate the switch instruction in accordance with the humidity information and transmit the switch instruction to the controller.

Alternatively, when the thermal insulation layer is switched between the state where the thermal insulation layer covers the vent holes completely and the state where the thermal insulation layer does not cover the vent holes, the instruction generation unit includes: a first comparator connected to the humidity sensor and configured to compare the humidity information detected by the humidity sensor with a humidity threshold; and a first control unit connected to the first comparator and the thermal insulation layer, and configured to, in the case that the first comparator determines that the humidity information detected by the humidity sensor is less than the humidity threshold, generate the switch instruction to enable the thermal insulation layer to completely cover the vent holes, and in the case that the first comparator determines that the humidity information detected by the humidity sensor is not less than the humidity threshold, generate the switch instruction to enable the thermal insulation layer not to cover the vent holes.

Alternatively, when the thermal insulation layer is switched among the state where the thermal insulation layer covers the vent holes completely, the state where the thermal insulation layer partially covers the vent holes and the state where the thermal insulation layer does not cover the vent holes, the instruction generation unit includes: a second comparator connected to the humidity sensor, and configured to compare the humidity information detected by the humidity sensor with a first threshold and a second threshold greater than the first threshold; and a second control unit connected to the second comparator and the thermal insulation layer, and configured to, in the case that the second comparator determines that the humidity information detected by the humidity sensor is less than the first threshold, generate the switch instruction to enable the thermal insulation layer to completely cover the vent holes, in the case that the second comparator determines that the humidity information detected by the humidity sensor is greater than or equal to the first threshold and less than or equal to the second threshold, generate the switch instruction to enable the thermal insulation layer to partially cover the vent holes, and in the case that the second comparator determines that the humidity information detected by the humidity sensor is greater than the second threshold, generate the switch instruction to enable the thermal insulation layer not to cover the vent holes.

Alternatively, the instruction generator includes: a sound sensor configured to detect sound information; and an instruction generation unit connected to the sound sensor, and configured to match the sound information with a pre-stored sound instruction information, and in the case that the sound information includes a sound instruction matching the pre-stored sound instruction information, generate the switch instruction and transmit the switch instruction to the controller.

Alternatively, the instruction generator is configured to generate the switch instruction in response to an operation made by a user.

Alternatively, the instruction generator includes a button configured to generate the switch instruction in response to a press operation made by the user.

Alternatively, the controller includes: a stationary rod fixed onto a first end of the vent holes; a mobile rod movably arranged on the vent holes and opposite to the stationary rod, and capable of being moved along the vent holes close to, or away from, the stationary rod; and a driving member connected to the mobile rod, and configured to drive the mobile rod to be moved close to, or away from, the stationary rod. One end of the thermal insulation layer is connected to the mobile rod, and the other end of the thermal insulation layer is fixed onto a second end of the vent holes opposite to the first end. In the case that the mobile rod is moved close to the stationary rod, a total area of the vent holes covered by the thermal insulation layer increases, and in the case that the mobile rod is moved away from the stationary rod, the total area of the vent holes covered by the thermal insulation layer decreases.

Alternatively, the driving member includes: an elastic telescopic member configured to connect the stationary rod to the mobile rod; and a control member connected to the elastic telescopic member, and configured to control a telescopic movement of the elastic telescopic member in response to the switch instruction, so as to drive the mobile rod to be moved close to, or away from, the stationary rod.

Alternatively, the thermal insulation layer is made of a flexible foldable fabric or an elastic telescopic fabric.

Alternatively, the controller includes: a stationary rod fixed onto an end of the vent hole; a mobile rod movably arranged on the vent hole and opposite to the stationary rod, and capable of being moved along the vent hole close to, or away from, the stationary rod; and a driving member connected to the mobile rod, and configured to drive the mobile rod to be moved close to, or away from, the stationary rod in response to the switch instruction. One end of the thermal insulation layer is connected to the mobile rod, and the other end of the thermal insulation layer is fixed onto the stationary rod. In the case that the mobile rod is moved close to the stationary rod, the total area of the vent holes covered by the thermal insulation layer decreases and in the case that the mobile rod is moved away from the stationary rod, the total area of the vent holes covered by the thermal insulation layer increases.

Alternatively, the driving member includes: an elastic telescopic member configured to connect the stationary rod to the mobile rod; and a control member connected to the elastic telescopic member, and configured to control a telescopic movement of the elastic telescopic member in response to the switch instruction, so as to drive the mobile rod to be moved close to, or away from, the stationary rod.

Alternatively, the thermal insulation layer is made of a flexible foldable fabric or an elastic telescopic fabric.

Alternatively, the base layer includes a stationary spindle, and a plurality of stationary sectors fixedly around the stationary spindle. The stationary sectors are spaced apart from each other with the vent holes defined between the adjacent stationary sectors. The thermal insulation layer includes a plurality of rotatable sectors around the stationary spindle. The rotatable sectors are spaced apart from each other and each have a shape adapted to a shape of the vent hole. The controller includes a driving member connected to the rotatable sectors and configured to drive the rotatable sectors to rotate around the stationary spindle in response to the switch instruction, so as to enable the rotatable sectors to cover the vent holes partially, cover the vent holes completely, or not to cover the vent holes.

In another aspect, the present disclosure provides in some embodiments an intelligent garment including a garment body. At least one portion of the garment body is made of the above-mentioned intelligent fabric.

Alternatively, the intelligent garment is an upper garment, and the at least one portion of the garment body includes an underarm portion, a chest portion or a back portion.

Alternatively, the intelligent garment is trousers, and the at least one portion of the garment body includes a popliteal portion.

According to the embodiments of the present disclosure, it is able for the intelligent garment including the intelligent fabric to keep the user warm at a low body temperature, and to dissipate heat rapidly at a high body temperature.

DETAILED DESCRIPTION OF THE EMBODIMENTS

The present disclosure will be described hereinafter in conjunction with the drawings and embodiments. The following embodiments are for illustrative purposes only, but shall not be used to limit the scope of the present disclosure.

Figure 1:
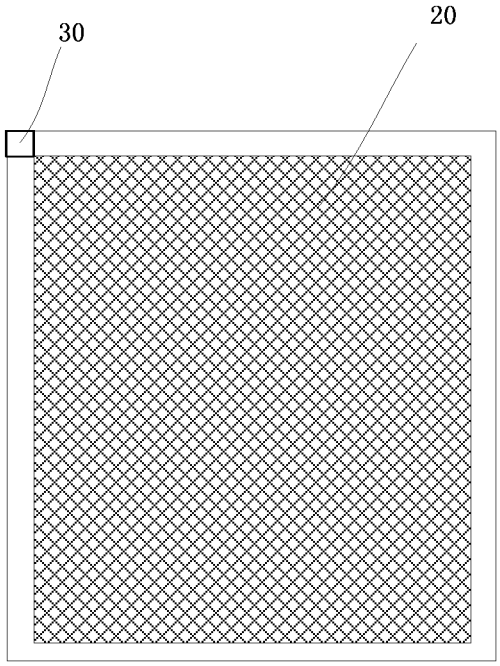
FIG. 1 is a schematic view showing an intelligent fabric in a warm-keeping state according to one embodiment of the present disclosure.
Figure 2:
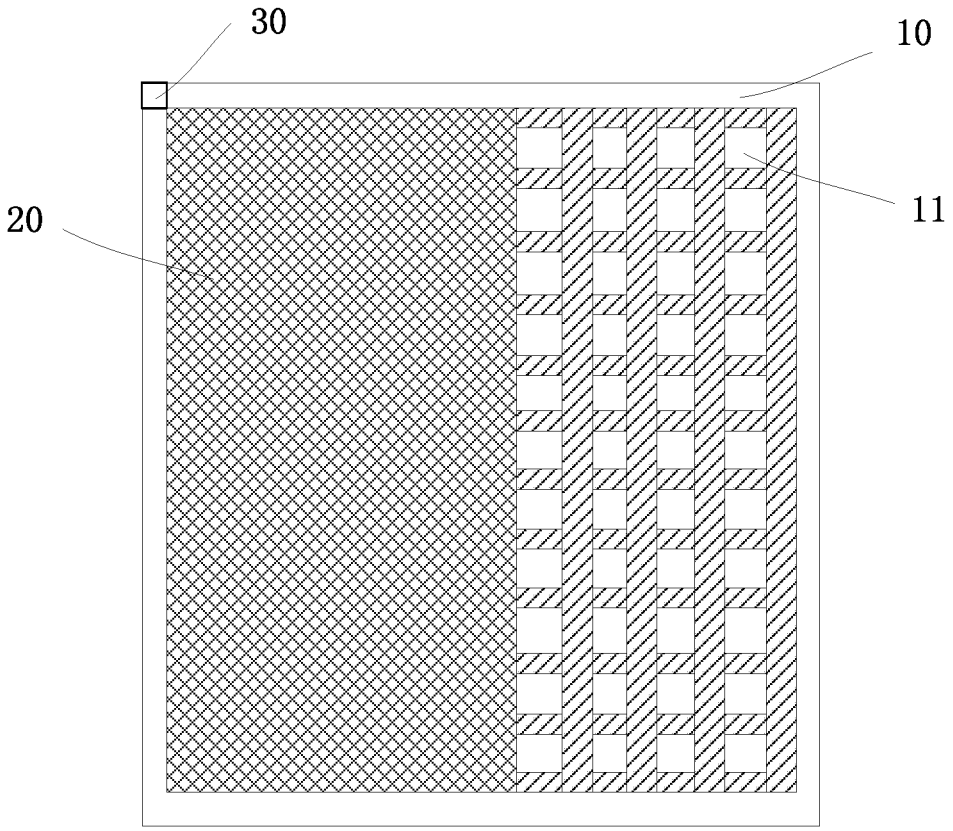
FIGS. 2 and 3 are schematic views showing the intelligent fabric in a ventilation state in FIG. 1.
Figure 3:
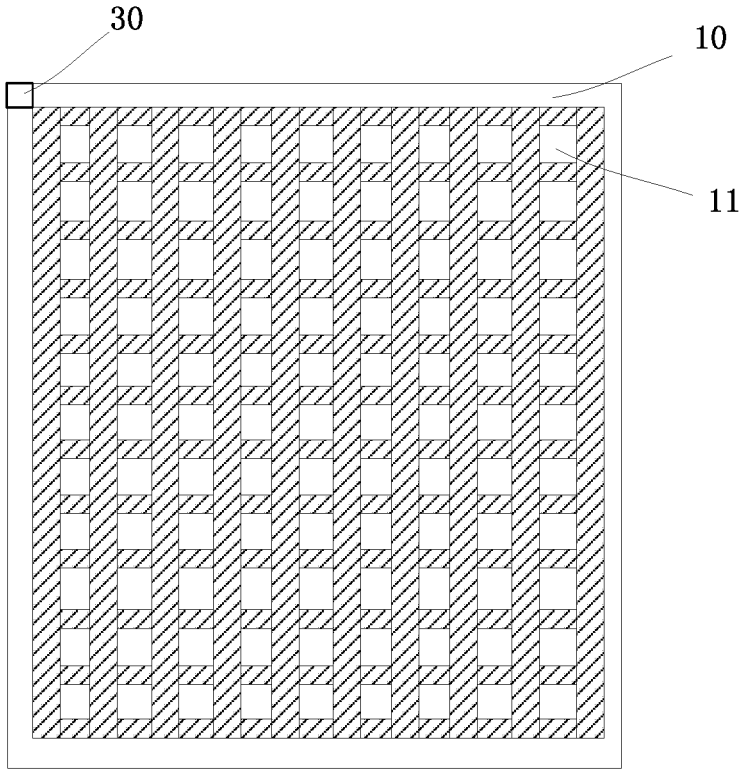
Figure 4:
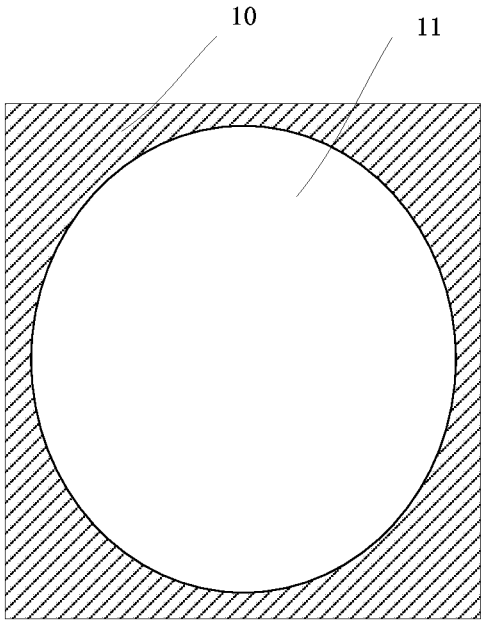
FIG. 4 is a schematic view showing the intelligent fabric according to one embodiment of the present disclosure.
Figure 12:
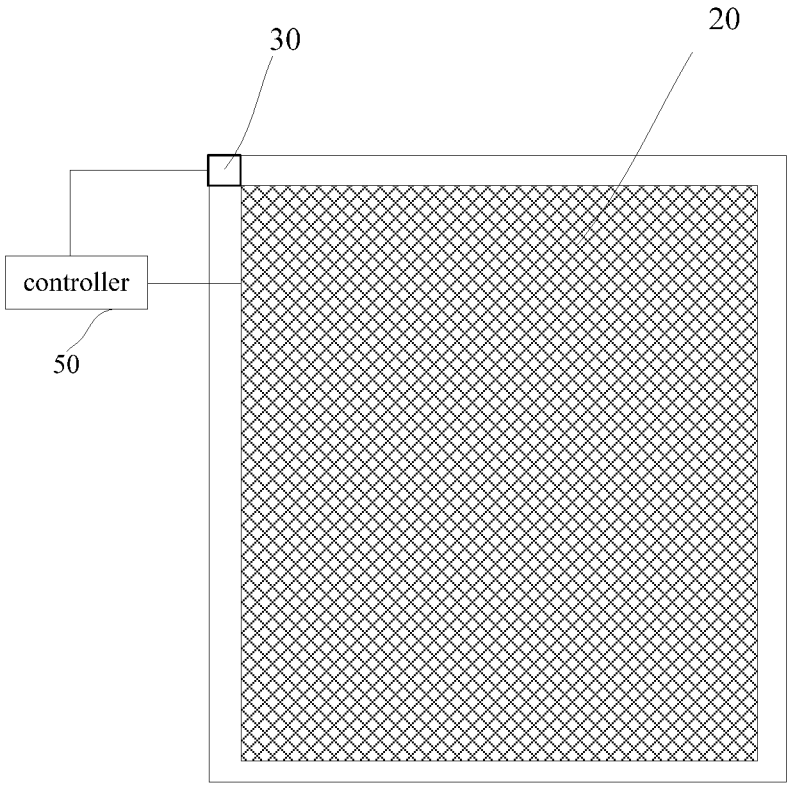
FIG. 12 is another schematic view showing the intelligent garment with a controller according to one embodiment of the present disclosure.

In order to keep a user warm at a low body temperature and dissipate heat rapidly at a high body temperature, the present disclosure provides in some embodiments an intelligent fabric which, as shown in FIGS. 1-3, includes a base layer 10, a thermal insulation layer 20, an instruction generator 30 and a controller 50 (as shown in FIG. 12).

The base layer 10 is provided with vent holes 11. The thermal insulation layer 20 is arranged on the base layer 10 and capable of being moved relative to the base layer 10. The instruction generator 30 is configured to generate a switch instruction.

The controller 50 is connected to the instruction generator 30 and the thermal insulation layer 20, and configured to control the thermal insulation layer 20 to be moved relative to the base layer 10 in accordance with the switch instruction from the instruction generator 30, so as to switch the thermal insulation layer 20 between a state where the thermal insulation layer 20 covers the vent holes 11 completely (as shown in FIG. 1) and a state where the thermal insulation layer 20 does not cover the vent holes 11 (as shown in FIG. 3), or among the state where the thermal insulation layer 20 covers the vent holes 11 completely, a state where the thermal insulation layer 20 partially covers the vent holes 11 (as shown in FIG. 2), and the state where the thermal insulation layer 20 does not cover the vent holes 11.

The number of the vent holes in the base layer 10 is not particularly defined herein. For example, there may be one or more vent holes 11. In addition, a shape of the vent hole 11 is not particularly defined herein either. For example, the vent hole 11 may be of a circular or rectangular shape. It should be appreciated that, the larger the size of the vent hole, the better the resultant ventilation effect.

The thermal insulation layer 20 needs to be made of a fabric having a warm-keeping function. In some embodiments of the present disclosure, the thermal insulation layer 20 may be switched between two states, i.e., the state where it completely covers the vent holes 11 and the state where it does not cover the vent holes 11. In some other embodiments of the present disclosure, the thermal insulation layer 20 may be switched among three states, i.e., the state where it completely covers the vent holes 11, the state where it does not cover the vent holes 11, and the state where it partially covers the vent holes 11. In the case that the thermal insulation layer 20 partially covers the vent holes 11, merely a half of the total area of the vent holes 11 may be covered. Of course, one third of, a half of or two thirds of the total area of the vent holes 11 may be covered. In the case that the thermal insulation layer 20 covers the vent holes 11 completely, the intelligent fabric is in a warm-keeping state, and in the case that the thermal insulation layer 20 partially covers, or does not cover, the vent holes 11, the intelligent fabric is in a ventilation state.

According to the embodiments of the present disclosure, it is able for the intelligent garment including the intelligent fabric to keep the user warm at a low body temperature, and to dissipate heat rapidly at a high body temperature, thereby to be adapted to different scenarios.

The instruction generator 30 may be in various forms, which will be described illustratively hereinafter.

Figure 13:
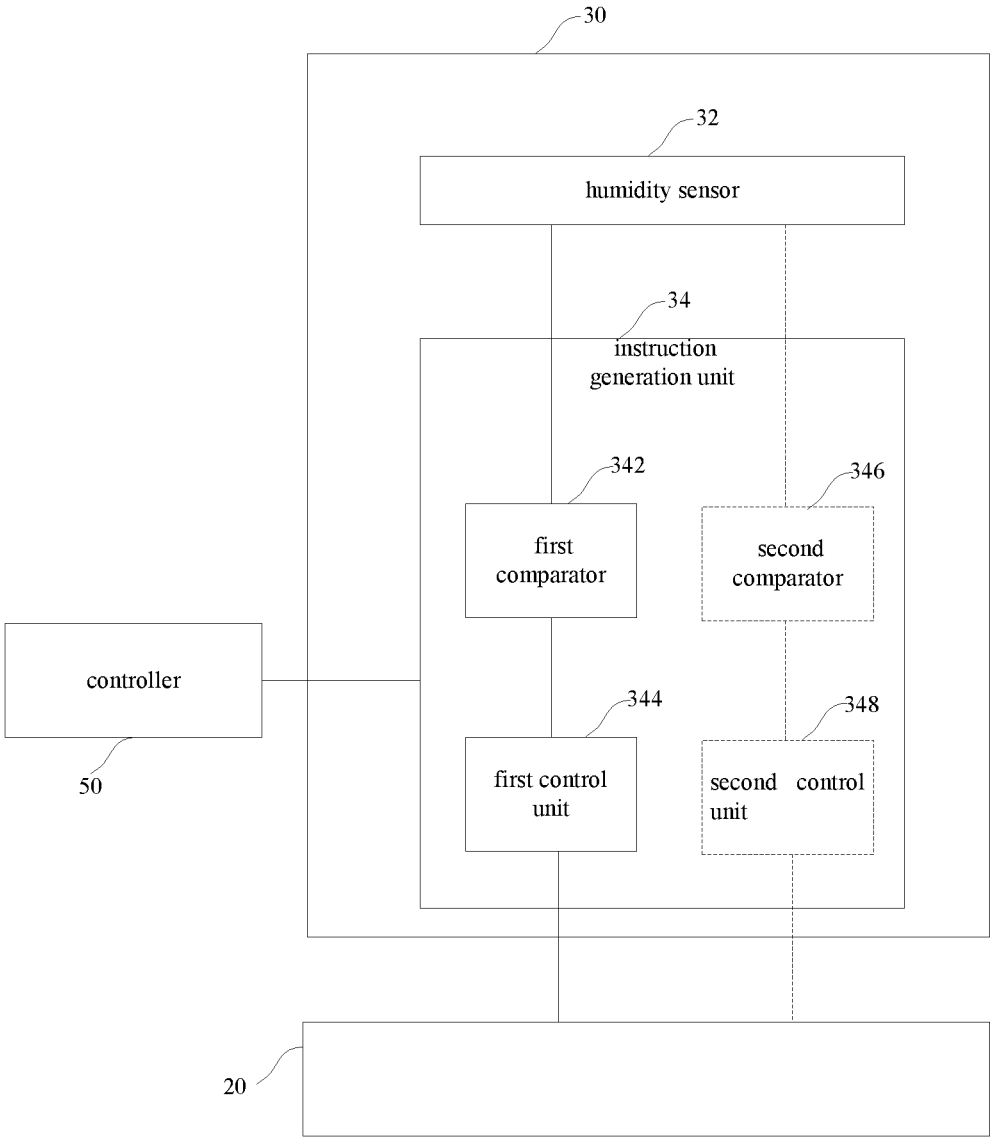
FIG. 13 is a schematic view showing an instruction generator and a controller according to one embodiment of the present disclosure.

In some embodiments of the present disclosure, as shown in FIG. 13, the instruction generator 30 may include a humidity sensor 32 and an instruction generation unit 34. The humidity sensor 32 is configured to detect humidity information, and the instruction generation unit 34 is connected to the humidity sensor, and configured to generate the switch instruction in accordance with the humidity information and transmit the switch instruction to the controller.

In the case that the thermal insulation layer 20 may be switched between the state where it covers the vent holes 11 completely and the state where it does not cover the vent holes 11, the instruction generation unit may include a first comparator 342 and a first control unit 344.

The first comparator 342 is connected to the humidity sensor and configured to compare the humidity information detected by the humidity sensor with a humidity threshold.

The first control unit 344 is connected to the first comparator and the thermal insulation layer 20, and configured to, in the case that the first comparator determines that the humidity information detected by the humidity sensor is less than the humidity threshold, generate the switch instruction to enable the thermal insulation layer 20 to completely cover the vent holes 11, and in the case that the first comparator determines that the humidity information detected by the humidity sensor is not less than the humidity threshold, generate the switch instruction to enable the thermal insulation layer 20 not to cover the vent holes 11.

In this embodiment of the present disclosure, the thermal insulation layer may merely be switched between two states, so as to simplify a control mode and reduce the production cost.

In the case that the thermal insulation layer 20 may be switched between the state where it covers the vent holes 11 completely, the state where it partially covers the vent holes 11 and the state where it does not cover the vent holes 11, the instruction generation unit may include a second comparator 346 and a second control unit 348.

The second comparator 346 is connected to the humidity sensor, and configured to compare the humidity information detected by the humidity sensor with a first threshold and a second threshold which is greater than the first threshold. The first threshold and the second threshold are provided so as to define a humidity range, and they may be set in accordance with the practical need.

The second control unit 348 is connected to the second comparator and the thermal insulation layer, and configured to, in the case that the second comparator determines that the humidity information detected by the humidity sensor is less than the first threshold, generate the switch instruction to enable the thermal insulation layer 20 to completely cover the vent holes 11, in the case that the second comparator determines that the humidity information detected by the humidity sensor is greater than or equal to the first threshold and less than or equal to the second threshold, generate the switch instruction to enable the thermal insulation layer 20 to partially cover the vent holes 11, and in the case that the second comparator determines that the humidity information detected by the humidity sensor is greater than the second threshold, generate the switch instruction to enable the thermal insulation layer 20 not to cover the vent holes 11.

In this embodiment of the present disclosure, the thermal insulation layer 20 may be switched among three states, so as to meet the requirements in a better manner.

In the embodiments of the present disclosure, there may be one or more humidity sensors. In the case that there are more than one humidity sensors, the state of the thermal insulation layer 20 may be switched as long as the humidity information detected by any one of the humidity sensors meet the condition.

In the embodiments of the present disclosure, the humidity sensor may detect the ambient humidity, and the intelligent fabric may be switched between the warm-keeping state and the ventilation state in accordance with the ambient humidity. As a result, it is able to switch the intelligent fabric into the ventilation state in the case that the user sweats (the humidity increases), and switch the intelligent fabric into the warm-keeping state in the case that the humidity decreases.

Figure 14:
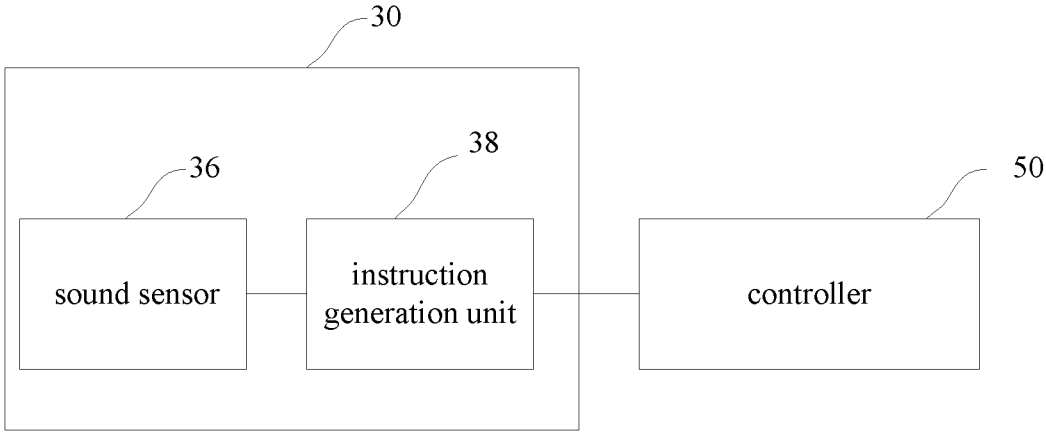
FIG. 14 is another schematic view showing the instruction generator and the controller according to one embodiment of the present disclosure.

In some other embodiments of the present disclosure, as shown in FIG. 14, the instruction generator may include a sound sensor 36 and an instruction generation unit 38. The sound sensor is configured to detect sound information. The instruction generation unit is connected to the sound sensor, and configured to match the sound information with pre-stored sound instruction information, and in the case that the sound information includes a sound instruction matching the pre-stored sound instruction information, generate the switch instruction and transmit the switch instruction to the controller.

In the embodiments of the present disclosure, a sound instruction of the user may be detected by the sound sensor, and then the intelligent fabric may be switched between the warm-keeping state and the ventilation state in accordance with the sound instruction. In this way, it is able to facilitate the user's operation and meet the user's requirements in a better manner.

In some other embodiments of the present disclosure, the instruction generator may generate the switch instruction in response to an operation of the user. For example, the instruction generator may include a button configured to generate the switch instruction in response to a press operation of the user, or a rotary knob configured to generate the switch instruction in response to a rotation operation of the user.

The structures of the base layer 10, the thermal insulation layer 20 and the controller will be described hereinafter.

Figure 5:
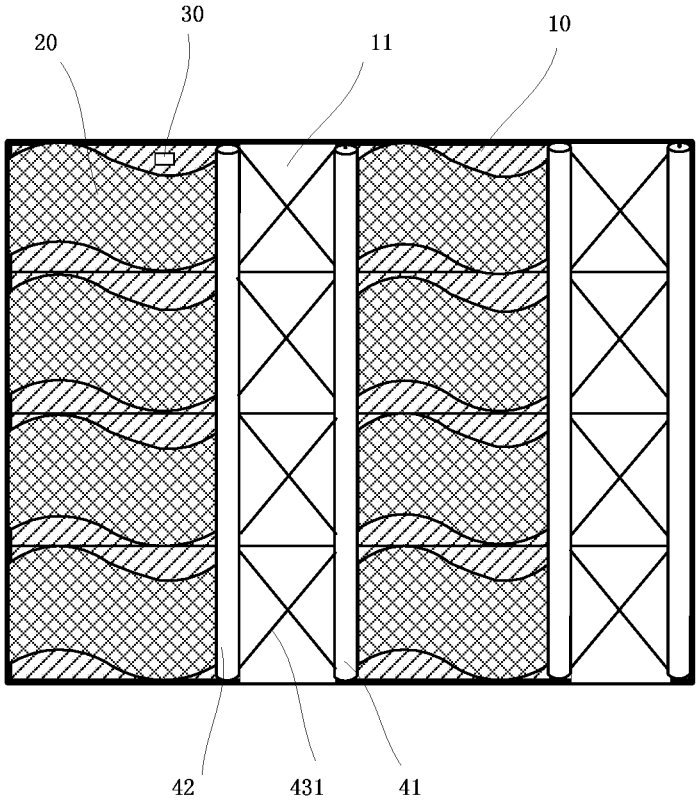
FIG. 5 is a schematic view showing the intelligent fabric in the ventilation state according to one embodiment of the present disclosure.
Figure 6:
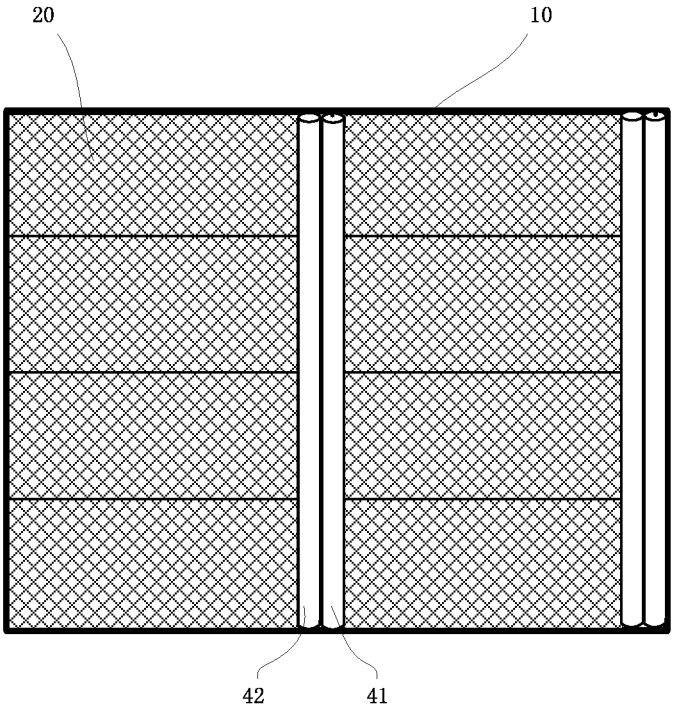
FIG. 6 is another schematic view showing the intelligent fabric in a thermal-insulation state in FIG. 5.

Referring to FIGS. 5 and 6, which are schematic views showing the intelligent fabric according to one embodiment of the present disclosure, the intelligent fabric includes the base layer 10, the thermal insulation layer 20, the instruction generator 30 and the controller. The base layer 10 is provided with vent holes 11. The thermal insulation layer 20 is arranged on the base layer 10 and capable of being moved relative to the base layer 10. The instruction generator 30 is configured to generate a switch instruction.

The controller is connected to the instruction generator 30 and the thermal insulation layer 20, and configured to control the thermal insulation layer 20 to be moved relative to the base layer 10 in accordance with the switch instruction from the instruction generator 30, so as to switch the thermal insulation layer 20 between a state where the thermal insulation layer 20 covers the vent holes 11 completely and a state where the thermal insulation layer 20 does not cover the vent holes 11, or among the state where the thermal insulation layer 20 covers the vent holes 11 completely, a state where the thermal insulation layer 20 partially covers the vent holes 11, and the state where the thermal insulation layer 20 does not cover the vent holes 11.

The controller includes a stationary rod 41, a mobile rod 42 and a driving member. The stationary rod 41 is fixed onto a first end of the vent hole 11. The mobile rod 42 is movably arranged on the vent hole 11 and opposite to the stationary rod 41, and it is capable of being moved along the vent hole 11 close to, or away from, the stationary rod 41. The driving member is connected to the mobile rod 42, and configured to drive the mobile rod 42 to be moved close to, or away from, the stationary rod 41 according to the switch instruction.

In the embodiments of the present disclosure, one end of the thermal insulation layer 20 is connected to the mobile rod 42, and the other end of the thermal insulation layer 20, opposite to the first end, is fixed onto a second end of the vent hole 11. In the case that the mobile rod 42 is moved close to the stationary rod 41, a total area of the vent holes 11 covered by the thermal insulation layer 20 increases, and in the case that the mobile rod 42 is moved away from the stationary rod 41, the total area of the vent holes 11 covered by the thermal insulation layer 20 decreases.

The thermal insulation layer 20 may be made of a flexible foldable fabric or an elastic telescopic fabric.

In the case that the thermal insulation layer 20 is made of the flexible foldable fabric and the mobile rod 42 is moved away from the stationary rod 41, the thermal insulation layer 20 may be folded or wound onto the mobile rod 42. In the case that the mobile rod 42 is moved close to the stationary rod 41, the thermal insulation layer 20 may be extended.

In the case that the thermal insulation layer 20 is made of the elastic telescopic fabric and the mobile rod 42 is moved away from the stationary rod 41, the thermal insulation layer 20 may be in a retraction state. In the case that the mobile rod 42 is moved close to the stationary rod 41, the thermal insulation layer 20 may be in an extension state.

In some embodiments of the present disclosure, one end of the thermal insulation layer 20 may be connected to the mobile rod 42, and the other end of the thermal insulation layer 20 may be fixed onto the stationary rod 41. In the case that the mobile rod 42 is moved close to the stationary rod 41, the total area of the vent holes 11 covered by the thermal insulation layer 20 decreases, and in the case that the mobile rod 42 is moved away from the stationary rod 41, the total area of the vent holes 11 covered by the thermal insulation layer 20 increases.

In the embodiments of the present disclosure, identically, the thermal insulation layer 20 may be made of a flexible foldable fabric or an elastic telescopic fabric.

In the case that the thermal insulation layer 20 is made of the flexible foldable fabric and the mobile rod 42 is moved close to the stationary rod 41, the thermal insulation layer 20 may be folded or wound onto the mobile rod 42. In the case that the mobile rod 42 is moved away from the stationary rod 41, the thermal insulation layer 20 may be extended.

In the case that the thermal insulation layer 20 is made of the elastic telescopic fabric and the mobile rod 42 is moved close to the stationary rod 41, the thermal insulation layer 20 may be in a retraction state. In the case that the mobile rod 42 is moved away from the stationary rod 41, the thermal insulation layer 20 may in an extension state.

In the above-mentioned embodiments, the driving member may include an elastic telescopic member 431 and a control member. The elastic telescopic member 431 is configured to connect the stationary rod 41 to the mobile rod 42. The control member is connected to the elastic telescopic member 431, and configured to control a telescopic movement of the elastic telescopic member 431 in response to the switch instruction, so as to drive the mobile rod 42 to be moved close to, or away from, the stationary rod 41.

Of course, in some other embodiments of the present disclosure, the driving member may be of any other structures. For example, the driving member may include two sliding rails arranged opposite to each other and a control member. At this time, the two ends of the mobile rod 42 are arranged in the two sliding rails respectively, and the control member is configured to control the movement of the mobile rod 42 along the sliding rails in response to the switch instruction, so as to be moved close to, or away from, the stationary rod 41.

Figure 7:
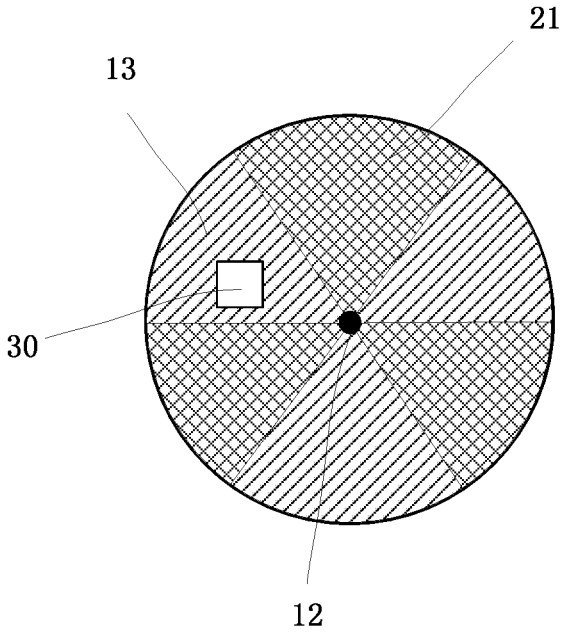
FIG. 7 is a schematic view showing the intelligent fabric in the warm-keeping state according to one embodiment of the present disclosure.
Figure 8:
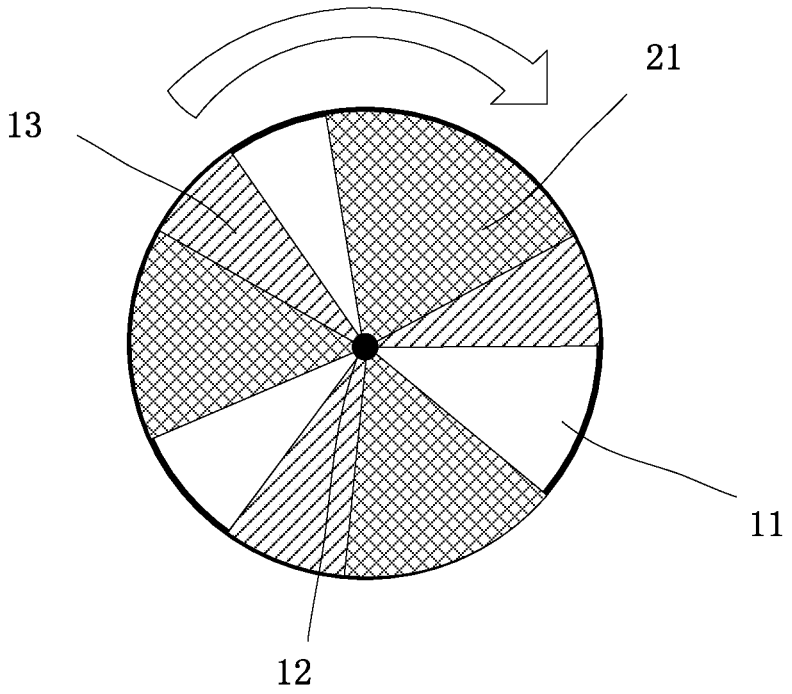
FIGS. 8 and 9 are schematic views showing the intelligent fabric in the ventilation state in FIG. 7.
Figure 9:
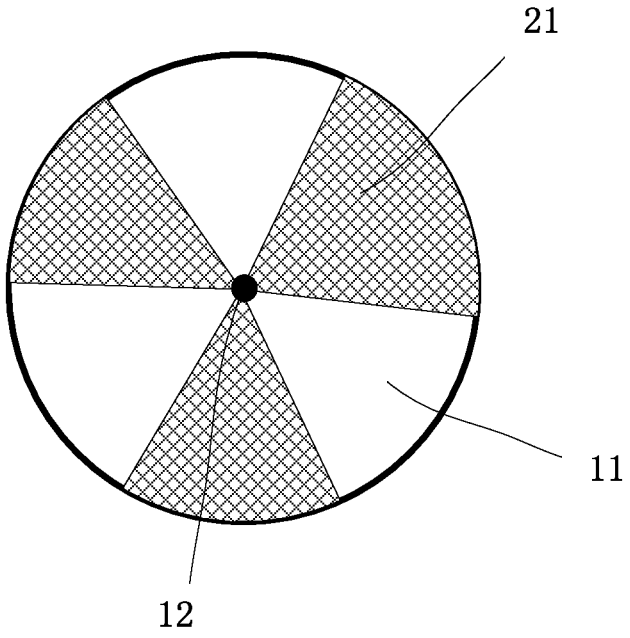

Referring to FIGS. 7-9, which are schematic views showing the intelligent fabric according to one embodiment of the present disclosure, the intelligent fabric includes the base layer, the thermal insulation layer, the instruction generator 30 and the controller.

The base layer is provided with the vent holes 11. The thermal insulation layer is arranged on the base layer and capable of being moved relative to the base layer.

The base layer includes a stationary spindle 12, and a plurality of stationary sectors 13 arranged fixedly around the stationary spindle 12. The stationary sectors 13 are spaced apart from each other, and the vent hole 11 is arranged between the adjacent stationary sectors 13. The thermal insulation layer includes a plurality of rotatable sectors 21 around the stationary spindle 13. The rotatable sectors 21 are spaced apart from each other and each have a shape adapted to a shape of the vent hole 11. Alternatively, the rotatable sector 21 is of a shape and a size identical to the stationary sector 13. The instruction generator 30 is configured to generate a switch instruction.

The controller is connected to the instruction generator 30 and the thermal insulation layer, and configured to control the thermal insulation layer to be moved relative to the base layer in accordance with the switch instruction from the instruction generator 30, so as to switch the thermal insulation layer between a state where the thermal insulation layer covers the vent holes 11 completely (as shown in FIG. 7) and a state where the thermal insulation layer does not cover the vent holes 11 (as shown in FIG. 9), or among the state where the thermal insulation layer covers the vent holes 11 completely, a state where the thermal insulation layer partially covers the vent holes 11 (as shown in FIG. 8), and the state where the thermal insulation layer does not cover the vent holes 11.

The controller includes a driving member connected to the rotatable sectors 21 and configured to drive the rotatable sectors 21 to rotate around the stationary spindle 12 in response to the switch instruction, so as to enable the rotatable sectors 21 to cover the vent holes 11 partially, cover the vent holes 11 completely, or not to cover the vent holes 11.

The stationary sectors 13 and the rotatable sectors 21 may each be made of a common fabric, or a warm-keeping fabric.

Figure 10:
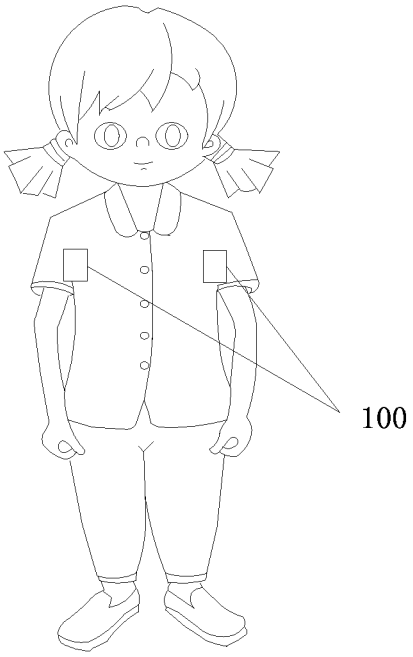
FIGS. 10 and 11 are schematic views showing an intelligent garment according to one embodiment of the present disclosure.
Figure 11:
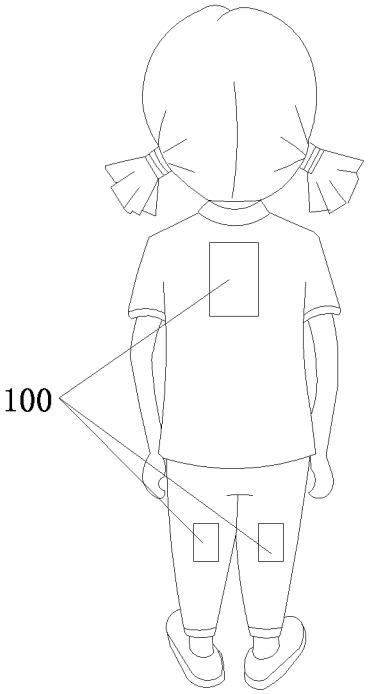

As shown in FIGS. 10-11, the present disclosure further provides in some embodiments an intelligent garment including a garment body. At least a portion of the garment body is made of the above-mentioned intelligent fabric 100.

In the case that the intelligent garment is an upper garment, the at least portion of the garment body includes an underarm portion, a chest portion or a back portion.

In the case that the intelligent garment is trousers, the at least portion of the garment body includes a popliteal portion.

In the case that the user is dressed in the above-mentioned intelligent garment, it is unnecessary to take the ambient temperature into consideration during the exercise, i.e., it is able to keep warm and rapidly dissipate the heat generated during the exercise, thereby to prevent the user from being adversely affected due to a difference in the temperatures during the exercise and before or after the exercise.

For example, in winter, the ambient temperature is relatively low, and a body temperature is low before and after the exercise. At this time, the intelligent fabric is in the warm-keeping state under the control of the instruction generator. In the case that the user starts to take exercise and the body temperature increases, the intelligent fabric may be switched to the ventilation state, so as to dissipate the heat in time and meanwhile maintain the temperature at the portions of the body where sweat seldom occurs. In the case that the user has completed the exercise, the body temperature may decrease rapidly due to the intelligent garment in the ventilation state, and the user may easily catch a cold. At this time, the intelligent fabric may be switched from the ventilation state to the warm-keeping state, so as to maintain the body temperature.

The above are merely the optional embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. An intelligent fabric, comprising:

a base layer with vent holes;

a thermal insulation layer on the base layer and capable of being moved relative to the base layer;

an instruction generator configured to generate a switch instruction; and a controller connected to the instruction generator and the thermal insulation layer, and configured to control the thermal insulation layer to be moved relative to the base layer in accordance with the switch instruction from the instruction generator, so as to switch the thermal insulation layer between a state where the thermal insulation layer covers the vent holes completely and a state where the thermal insulation layer does not cover the vent holes, or among the state where the thermal insulation layer covers the vent holes completely, a state where the thermal insulation layer partially covers the vent holes, and the state where the thermal insulation layer does not cover the vent holes;

wherein the controller includes a stationary rod fixed onto a first end of the vent holes, a mobile rod movably arranged on the vent holes and opposite the stationary rod, the mobile rod being capable of being moved along the vent holes close to, or away from, the stationary rod, and a driving member connected to the mobile rod, the driving member being configured to drive the mobile rod to be moved close to, or away from, the stationary rod, in response to the switch instruction, wherein one end of the thermal insulation layer is connected to the mobile rod and the other end of the thermal insulation layer is fixed onto a second end of the vent holes opposite the first end, when the mobile rod is moved close to the stationary rod, a total area of the vent holes covered by the thermal insulation layer increases, and when the mobile rod is moved away from the stationary rod, the total area of the vent holes covered by the thermal insulation layer decreases.

2. The intelligent fabric according to claim 1, wherein the instruction generator includes a humidity sensor configured to detect humidity information, and an instruction generation unit connected to the humidity sensor, the instruction generation unit being configured to generate the switch instruction in accordance with the humidity information and transmit the switch instruction to the controller.

3. The intelligent fabric according to claim 2, wherein when the thermal insulation layer is switched between the state where the thermal insulation layer covers the vent holes completely and the state where the thermal insulation layer does not cover the vent holes, the instruction generation unit includes a first comparator connected to the humidity sensor, the first comparator being configured to compare the humidity information detected by the humidity sensor with a humidity threshold, and a first control unit connected to the first comparator and the thermal insulation layer, the first control unit being configured to generate the switch instruction to enable the thermal insulation layer to completely cover the vent holes when the first comparator determines that the humidity information detected by the humidity sensor is less than the humidity threshold, and generate the switch instruction to enable the thermal insulation layer not to cover the vent holes when the first comparator determines that the humidity information detected by the humidity sensor is not less than the humidity threshold.

4. The intelligent fabric according to claim 1, wherein when the thermal insulation layer is switched among the state where the thermal insulation layer covers the vent holes completely, the state where the thermal insulation layer partially covers the vent holes and the state where the thermal insulation layer does not cover the vent holes, the instruction generation unit includes a second comparator connected to the humidity sensor, the second comparator being configured to compare the humidity information detected by the humidity sensor with a first threshold and a second threshold greater than the first threshold, and a second control unit connected to the second comparator and the thermal insulation layer, the second control unit being configured to generate the switch instruction to enable the thermal insulation layer to completely cover the vent holes when the second comparator determines that the humidity information detected by the humidity sensor is less than the first threshold, generate the switch instruction to enable the thermal insulation layer to partially cover the vent holes when the second comparator determines that the humidity information detected by the humidity sensor is greater than or equal to the first threshold and less than or equal to the second threshold, and generate the switch instruction to enable the thermal insulation layer not to cover the vent holes when the second comparator determines that the humidity information detected by the humidity sensor is greater than the second threshold.

5. The intelligent fabric according to claim 1, wherein the instruction generator includes a sound sensor configured to detect sound information, and an instruction generation unit connected to the sound sensor, the instruction generation unit being configured to match the sound information with pre-stored sound instruction information and when the sound information includes a sound instruction matching the pre-stored sound instruction information, the instruction generation unit is configured to generate the switch instruction and transmit the switch instruction to the controller.

6. The intelligent fabric according to claim 1, wherein the instruction generator is configured to generate the switch instruction in response to an operation made by a user.

7. The intelligent fabric according to claim 6, wherein the instruction generator includes a button configured to generate the switch instruction in response to a press operation made by the user.

8. The intelligent fabric according to claim 1, wherein the driving member includes an elastic telescopic member configured to connect the stationary rod to the mobile rod, and a control member connected to the elastic telescopic member, the control member being configured to control a telescopic movement of the elastic telescopic member in response to the switch instruction, so as to drive the mobile rod to be moved close to, or away from, the stationary rod.

9. The intelligent fabric according to claim 1, wherein the thermal insulation layer is formed of a flexible foldable fabric or an elastic telescopic fabric.

10. An intelligent fabric, comprising:

a base layer with vent holes;

a thermal insulation layer on the base layer and capable of being moved relative to the base layer;

an instruction generator configured to generate a switch instruction; and a controller connected to the instruction generator and the thermal insulation layer, and configured to control the thermal insulation layer to be moved relative to the base layer in accordance with the switch instruction from the instruction generator, so as to switch the thermal insulation layer between a state where the thermal insulation layer covers the vent holes completely and a state where the thermal insulation layer does not cover the vent holes, or among the state where the thermal insulation layer covers the vent holes completely, a state where the thermal insulation layer partially covers the vent holes, and the state where the thermal insulation layer does not cover the vent holes, the controller includes a stationary rod fixed onto an end of the vent holes, a mobile rod movably arranged on the vent holes and opposite the stationary rod, the mobile rod being configured to move along the vent holes close to, or away from, the stationary rod, and a driving member connected to the mobile rod, the driving member being configured to drive the mobile rod to be moved close to, or away from, the stationary rod in response to the switch instruction, wherein one end of the thermal insulation layer is connected to the mobile rod and the other end of the thermal insulation layer is fixed onto the stationary rod, when the mobile rod is moved close to the stationary rod, the total area of the vent holes covered by the thermal insulation layer decreases, and when the mobile rod is moved away from the stationary rod, the total area of the vent holes covered by the thermal insulation layer increases.

11. The intelligent fabric according to claim 10, wherein the driving member includes an elastic telescopic member configured to connect the stationary rod to the mobile rod, and a control member connected to the elastic telescopic member, the control member being configured to control a telescopic movement of the elastic telescopic member in response to the switch instruction, so as to drive the mobile rod to be moved close to, or away from, the stationary rod.

12. The intelligent fabric according to claim 10, wherein the thermal insulation layer is formed of a flexible foldable fabric or an elastic telescopic fabric.

13. The intelligent fabric according to claim 1, wherein the base layer includes a stationary spindle and a plurality of stationary sectors fixed around the stationary spindle, the plurality of stationary sectors are spaced apart from each other with a respective vent hole of the vent holes being disposed between adjacent stationary sectors of the plurality of stationary sectors, the thermal insulation layer includes plurality of rotatable sectors around the stationary spindle, adjacent rotatable sectors of the plurality of rotatable sectors being spaced apart and each of the plurality of rotatable sectors having a shape adapted to a shape of the respective vent hole; and the controller includes a driving member connected to the plurality of rotatable sectors, the driving member being configured to drive the plurality of rotatable sectors to rotate around the stationary spindle in response to the switch instruction, so as to enable the plurality of rotatable sectors to cover the vent holes partially, cover the vent holes completely, or not to cover the vent holes.

14. An intelligent garment comprising:

a garment body, wherein at least one portion of the garment body is made of an intelligent fabric, and the intelligent fabric includes a base layer with vent holes, a thermal insulation layer on the base layer and capable of being moved relative to the base layer, an instruction generator contoured to generate a switch instruction, and a controller connected to the instruction generator and the thermal insulation layer, the controller being configured to control the thermal insulation layer to be moved relative to the base layer in accordance with the switch instruction from the instruction generator, so as to switch the thermal insulation layer between a state where the thermal insulation layer covers the vent holes completely and a state where the thermal insulation layer does not cover the vent holes, or among the state where the thermal insulation layer covers the vent holes completely, a slate where the thermal insulation layer partially covers the vent holes, and the state where the thermal insulation layer does not cover the vent holes, the controller including a stationary rod fixed onto a first end of the vent holes, a mobile rod movably arranged on the vent holes and opposite the stationary rod, the mobile rod being capable of being moved along the vent holes close to, or away from, the stationary rod, and a driving member connected to the mobile rod, the driving member being configured to drive the mobile rod to be moved close to, or away from, the stationary rod, in response to the switch instruction, wherein one end of the thermal insulation layer is connected to the mobile rod and the other end of the thermal insulation layer is fixed onto a second end of the vent holes opposite the first end, when the mobile rod is moved close to the stationary rod, a total area of the vent holes covered by the thermal insulation layer increases, and when the mobile rod is moved away from the stationary rod, the total area of the vent holes covered by the thermal insulation layer decreases.

15. The intelligent garment according to claim 14, wherein the intelligent garment is an upper garment, and the at least one portion of the garment body comprises an underarm portion, a chest portion or a back portion.

16. The intelligent garment according to claim 14, wherein the intelligent garment is trousers, and the at least one portion of the garment body comprises a popliteal portion.

* * * * *